United States Patent [19]

Masuda

[11] Patent Number: 4,659,167

[45] Date of Patent: Apr. 21, 1987

[54] JACK WITH RECESSED CONTACTS

[75] Inventor: Toru Masuda, Osaka, Japan

[73] Assignee: Hosiden Electronics Co., Ltd., Japan

[21] Appl. No.: 653,105

[22] Filed: Sep. 21, 1984

[30] Foreign Application Priority Data

Sep. 30, 1983 [JP] Japan ..... 58-183894
Oct. 5, 1983 [JP] Japan ..... 58-155498[U]

[51] Int. Cl.[4] ..... H01R 13/50

[52] U.S. Cl. ..... 339/182 R; 339/183; 339/206 R; 339/218 M

[58] Field of Search ..... 339/182, 183, 218 R, 339/218 M, 196 R, 196 M, 206 R, 206 M, 177 R, 177 E

[56] References Cited

U.S. PATENT DOCUMENTS 3,541,497 11/1970 Kato ..... 339/277 R
3,900,709 9/1975 Sheesley et al. ..... 200/5 R
4,090,293 5/1978 van der Donk et al. ..... 339/218 R
4,269,467 5/1981 Hughes ..... 339/218 M
4,273,402 6/1981 Hughes ..... 339/206 R
4,274,691 6/1981 Abernathy et al. ..... 339/206 R
4,303,297 12/1981 Smart et al. ..... 339/218 M
4,367,907 1/1983 Buck ..... 339/183
4,423,288 12/1983 Webb ..... 339/218 M
4,451,106 5/1984 Wiseheart et al. ..... 339/206 R

*Primary Examiner*—Gil Weidenfeld
*Assistant Examiner*—David L. Pirlot
*Attorney, Agent, or Firm*—Jones, Tullar & Cooper

[57] ABSTRACT

This invention relates to a jack with recessed contacts, wherein a contact collection plate is formed by punching a metal plate. The contact collection plate includes a plurality of contacts which are arranged in the lateral direction of the contact collection plate so that they do not overlap one another when the contact collection plate is viewed in development. The jack also has a contact holding member of electrical insulating material within which one end of each contact is recessed. The plurality of contacts are formed by bending each part which is to become a contact relative to the recessed end.

11 Claims, 26 Drawing Figures

JACK WITH RECESSED CONTACTS

CROSS REFERENCE TO RELATED APPLICATION

This application discloses certain subject matter in common with application, Ser. No. 653,106, now U.S. Pat. No. 4,595,805, to the same assignee.

BACKGROUND OF THE INVENTION (1) Field of the Invention

This invention relates to a jack to be incorporated in audio apparatus, television sets, radio sets or the like, and more particularly to a jack comprising a plurality of contacts or contact segments (hereinafter called "contact") recessed into a contact holding member to be held therein, and of which manufacture is easily carried out.

(2) Description of the Prior Art

In the known jack, it is conventional that each contact is held in a contact holding member forming a part of a jack body in such a manner as to be engagedly fixed to each groove formed on said contact holding member of some electrical insulating material taking advantage of the resiliency of the material.

Accordingly, it is difficult to carry out the formation of each contact, formation of the contact holding member and incorporation of each contact into the contact holding member continuously on the same line, and it seems almost impossible to realize automation in manufacturing of the contact holding member while holding the plurality of contacts therein. For that reason, it is generally known to manually conduct the incorporation of each contact into the contact holding member. And in manual incorporation, there inevitably arise such problems such as irregularity in accuracy due to unequal formation of contacts, depending upon the experience of skill of the worker, tarnish on the plated surface of the contact due to stains sticking thereto when handling the contact, imperfect contact or the like.

Furthermore, since the contacts are simply engagedly fixed to the contact holding member as in the case of the prior art, there is a possibility of producing unexpected play or looseness in the contacts caused by some error in the manufacturing or assembling process or by long periods of use resulting in deviation in the accuracy of the product.

SUMMARY OF THE INVENTION

In order to solve the above-discussed problems, an object of this invention is to provide a jack comprising a contact holding member equipped with a plurality of contacts, manufacture of which is automated and easily produced.

Another object of this invention is to provide a jack in which irregularities in accuracy due to the unequal formation of contacts depending upon the skill of the worker, and imperfect contact due to adhering stains when handling the contact are sufficiently prevented, thereby securing uniformity in accuracy of the jack.

A further object of this invention is to provide a jack in which contacts are securely held in the contact holding member so that the contacts may be sufficiently prevented from any play or looseness due to long periods of use.

A still further object of this invention is to provide a jack of which the jack body is small-sized.

In order to accomplish the preceding objects, there is provided a jack with recessed contacts, wherein a contact collection plate is obtained by punching a metal plate, the contact collection plate being arranged at a position which deviates in the lateral direction in such a manner that each contact does not overlap one another in the developed state in the direction of the thickness thereof. A plurality of contacts are formed by bending a part which is to be each contact, and each part to be recessed of the contact collection plate is recessed in a part of the contact holding member made of electrical insulating material, and is held therein before bending.

BRIEF DESCRIPTION OF THE DRAWINGS

Other features and advantages of this invention will become apparent from the following description of preferred embodiments of this invention given in conjunction with the accompanying drawings wherein:

FIGS. 1 to 4 illustrate a first embodiment in accordance with this invention, and wherein;

FIG. 1 is a longitudinal sectional view of a jack in which a plug is inserted;

FIG. 2 is a longitudinal sectional view of a contact holding member;

FIG. 3 is a plan view of a contact collection plate;

FIG. 4 is a transverse sectional view of the contact holding member illustrating each contact in the developed state and recessed in the contact holding member;

FIGS. 5 to 6 illustrate a second embodiment, and wherein;

FIG. 5 is a longitudinal sectional view illustrating a modification in bending contacts contacting and separating one another;

FIG. 6 is a longitudinal sectional view illustrating a contact being in contact with another contact in a relative contacting and separating operation;

FIGS. 8 to 10 illustrate a fourth embodiment as a further modification of the contacts and the contact holding member and wherein, FIG. 8 is a perspective view of the contact holding member being incorporated into a jack body;

FIG. 9 is a perspective view of the contact holding member in the developed state;

FIG. 10 is a transverse sectional view of the contact holding member in which the contact collection plate is recessed to be held there;

FIGS. 11 to 13 illustrate the fifth embodiment of a contact holding member incorporated into a jack body and wherein, FIG. 11 is a perspective view of an assembled jack;

FIG. 12 is a perspective view of a jack in the state before assembling;

FIG. 13 is a persective view of an essential part viewed from a different angle from that of FIG. 12;

FIGS. 15 to 23 illustrate a seventh embodiment in which a jack comprising recessed contacts in accordance with this invention is applied to a jack with a slide switch and wherein;

FIG. 15 is an exploded perspective view;

FIG. 16 is a partially cutaway plan view;

FIG. 17 is a longitudinal sectional side view;

FIG. 18 is a longitudinal sectional back view;

FIG. 19 is a front view;

FIG. 20 is a bottom view;

FIG. 21 is a side view;

FIG. 22 is a plan view of the contact collection plate in the developed state;

FIG. 23 is a sectional plan view of the contact holding member holding each contact before bending;

FIGS. 24 to 26 illustrate an eighth embodiment in which a jack is applied to a jack with a slide switch as a yet further modification and wherein, FIG. 24 is an exploded perspective view;

FIG. 25 is a partially cutaway plan view; and

FIG. 26 is a longitudinal sectional side view.

DESCRIPTION OF THE PREFERRED EMBODIMENTS

Referring now to the accompanying drawings, a first embodiment in accordance with this invention is illustrated in FIGS. 1 to 4. This embodiment relates to a jack with recessed switch contacts performing a relative contacting and separating operation with respect to each other.

Figure 1:
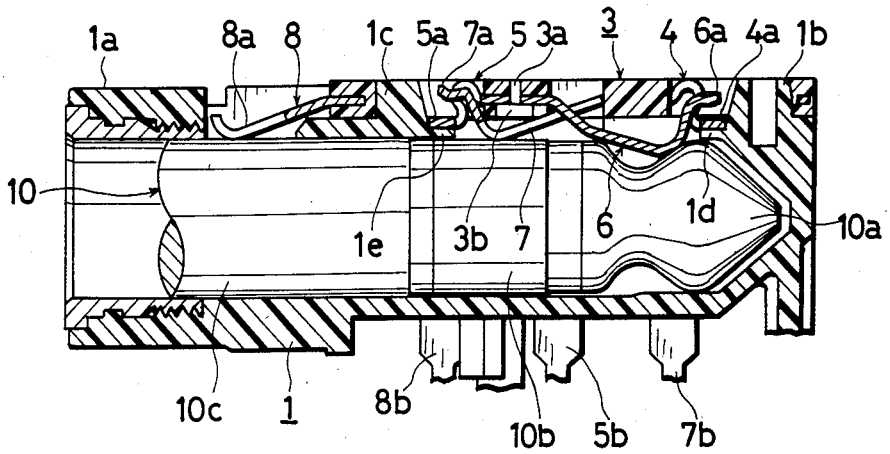

The jack of FIG. 1 comprises a box-shaped jack body 1 with its upper side open and the front wall of which is equipped with a plug insertion cylinder 1*a*. The jack also comprises a contact holding member 3 having a plurality of contacts and engagedly fixed to the upper opening of the body 1. The contact holding member 3 comprises two pairs of stationary contacts 4, 5 and movable contacts 6, 7 of which contacting and separating operation (or connection and disconnection) is conducted by putting a plug 10 in and out. A movable contact 8 performs the contacting and separating operation directly with respect to the plug 10 by putting the same in and out. The contact holding member forms a rectangular plate number in which said contacts 4 to 8 are recessed to be held therein. The jack body 1 and the contact holding member 3 are formed of electrical insulating resin material.

The contact holding member 3 is integrally formed by the hereinafter described process while the first and second stationary contacts 4, 5 as well as the first, second and third movable contacts 6, 7, 8 are inserted therein.

Figure 3:
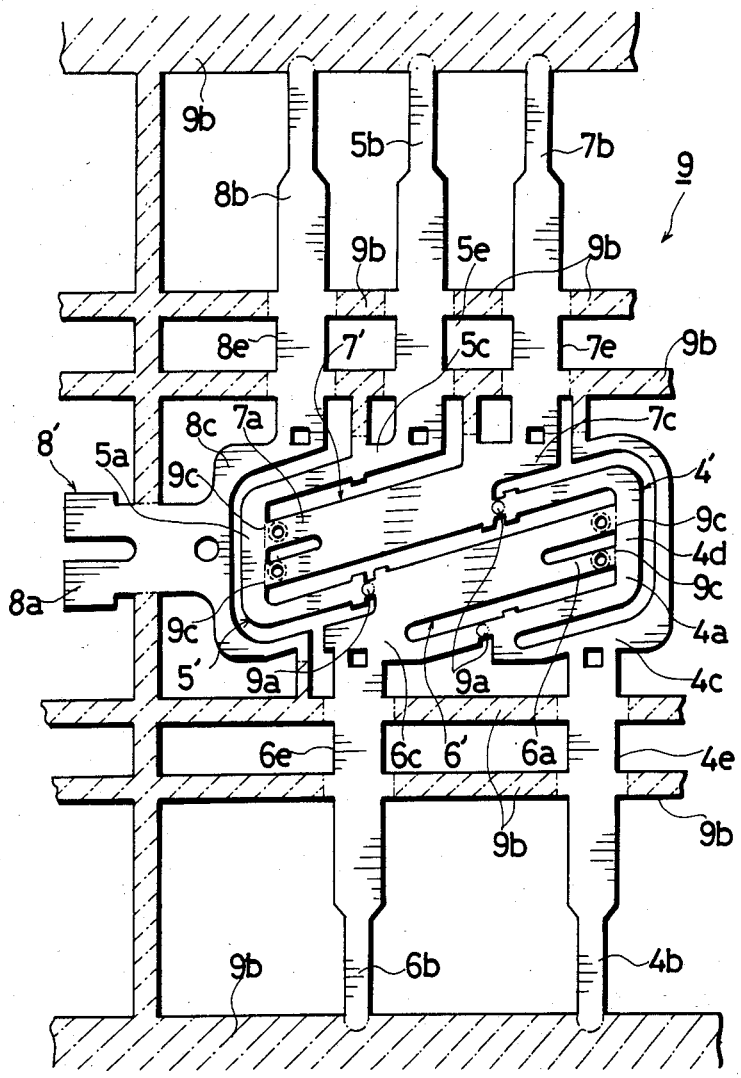
Figure 4:
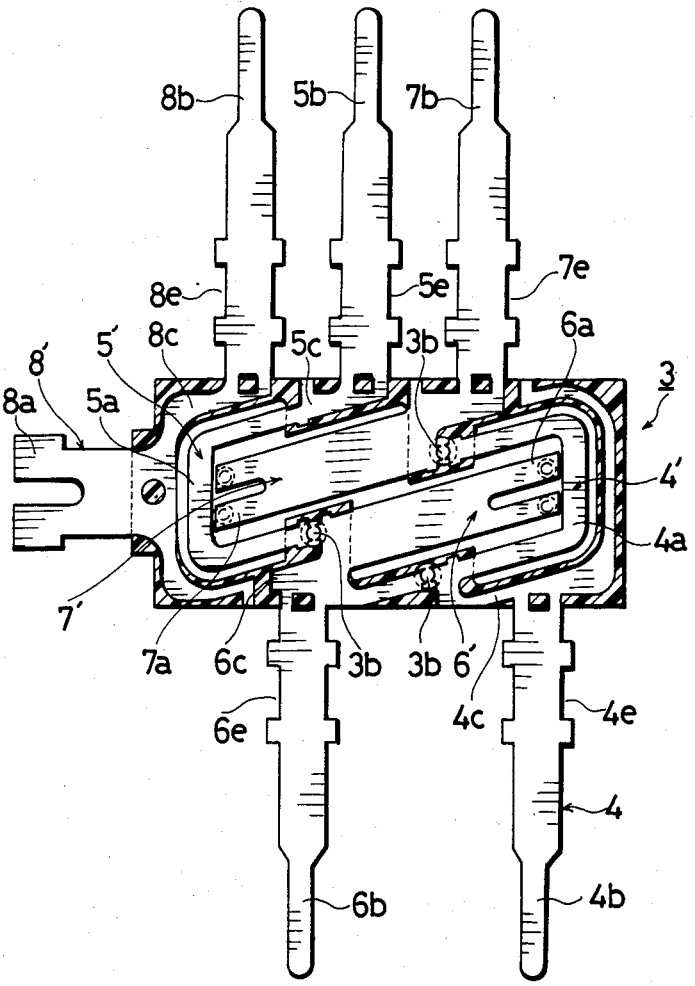

In the first step, as illustrated in FIG. 3, a metal plate is punched to obtain a contact collection plate 9 in which each part 4′ to 8′ to be formed into said each contact 4 to 8 is collectively placed connecting each other in any part thereof in the same plane so as not to overlap each other. In this step, it is preferred that as the case may be, relatively slight bending or projecting parts are formed beforehand to the extent not affecting the planeness of the contact collection plate 9. In the case of this first embodiment, such projecting parts or projections are formed on each end of contact areas 6*a*, 7*a* of the first and second movable contacts 6, 7.

Then, in order to secure satisfactory electro-conductivity of each contact 4 to 8, a highly electro-conductive film is formed on both sides of the contact collection plate 9. Namely, such electro-conductive material as silver is plated on both sides of the collection plate 9. Such plating, however, is not necessary when using some plated material or clad material as said plate.

The contact holding member 3 is formed by injection molding in a cavity between a male mold and a corresponding female mold (not illustrated). In this step, the contact collection plate 9 is horizontally held while a part to be recessed is placed in said cavity, said part to be recessed having each communicating portion 4*c* to 8*c* between each contact area 4*a* to 8*a* and each terminal 4*b* to 8*b* of each part 4′ to 8′ to become contacts 4 to 8 and having each portion 9*a* (to be cut off later) connected between each end of each contact area of the parts 4′, 6′ to be the first contacts 4, 6 and each end of each contact area of the parts 5′, 7′ to be the second contacts 5, 7.

In the next step, each unnecessary portion 9*b* (indicated by the hatching portions in FIG. 3) of the contact collection plate 9 is removed, each portion 9*c* connecting the contact areas of the parts 4′, 6′ to be the first contacts 4, 6 to each other and the contact areas of the parts 5′, 7′, to be the second contacts 5, 7, to each other, and the portions 9*a* are cut off respectively. Thus the contact holding member 3 is obtained while the parts 4′to 8′ to become contacts 4 to 8 are recessed and held in the separate state (see FIG. 4). In this respect, the portion 9*a* to be cut off is in a resin layer in the recessed state, and the cutting off thereof is conducted using through holes 3*a*, 3*b* provided vertically on the upper and lower sides of the portion 9*a* for introduction of a punching tool.

Then, a part not to be recessed, of the parts 4′ to 8′ is bent to form each contact 4 to 8 for the jack circuit. Namely, each contact area 6*a*, 7*a*, 8*a* of each movable contact 6, 7, 8 is bent downward forming a <-shape, and each contact area 4*a*, 5*a* of each stationary contact 4, 5 is bent under a corresponding contact area 6*a*, 7*a* of each movable contact 6, 7. Then the bending portions of each movable contact 6, 7, 8 are projected or extended downward from the under side of the contact holding plate 3 to a certain extent, and each contact area 6*a*, 7*a* of each movable contact 6, 7 is resiliently brought into contact with each contact area 4*a*, 5*a* of each stationary contact 4, 5.

Further, each terminal portion 4*b* to 8*b* of each part 4′ to 8′ is bent downwardly from the left and right sides of the contact holding member 3 respectively.

Figure 2:
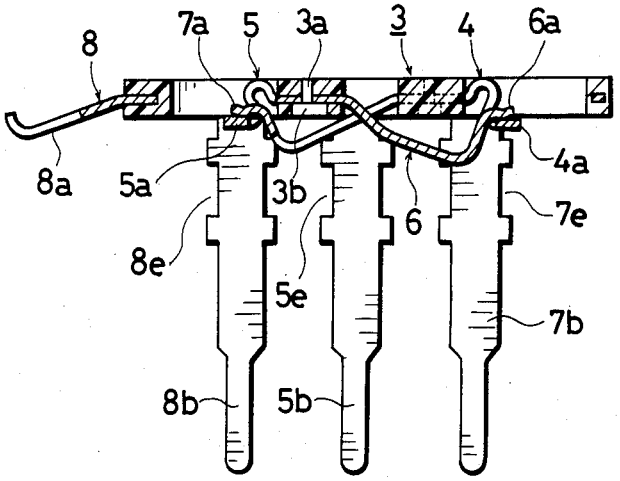

In this manner, the contact holding member 3 in which each contact 4 to 8 is recessed to be held therein is satisfactorily obtained or manufactured as illustrated in FIG. 2.

The contact holding member 3 thus obtained is engagedly fixed to the upper opening of the jack body 1 while the areas to be in contact with the plug 10, i.e. the bent portions of each contact area 6*a*, 7*a*, 8*a* are projected inside the plug insertion passage by engaging the contact holding member 3 with engaging parts 1*b*, 1*c* formed on the upper part of the jack body 1 and by engaging the recessed parts 4*e* to 8*e* formed on the terminals 4*b* to 8*b* of each contact 4 to 8 with each engaging parts (not illustrated) formed on the left and right sides of the jack body 1, respectively. In this respect, each contact area 4*a*, 5*a* of each stationary contact 4, 5 is supported on the supporting parts 1*d*, 1*e* formed on the jack body 1.

In the jack constructed as above-described, when inserting the plug 10 therein through the plug insertion cylinder 1*a*, each contact area 6*a*, 7*a*, 8*a* of the first, second and third movable contact 6, 7, 8 comes in contact with a chip 10*a*, a ring 10*b* and an ground device 10*c* respectively so that each contact area 6*a*, 7*a* of the first and second contacts 6, 7 is separated upward from each corresponding contact area 4*a*, 5*a* of the first and second stationary contacts 4, 5 (see FIG. 1).

By employing the foregoing construction, the step of obtaining the contact collection plate 9 from a metal plate, the step of injection molding the contact holding member 3 while the contact collection plate 9 is inserted therein, and the step of obtaining each contact 4 to 8 separated from the contact collection plate 9 and bent to a required shape can be continuously carried out on the same line, thus automation in manufacturing the contact holding member 3 while holding each contact 4 to 8 therein becomes easily feasible. Consequently, by incorporating the contact holding member 3 into the jack body 1, a jack is quite easily and efficiently manufactured. And the manual work required in the known art for the incorporation of each contact into the jack body is no longer necessary and the manufacture of the switch structure, or eventually the manufacture of the whole jack can be efficiently carried out, contributing greatly to the provision of the jack at reasonable cost. Besides, there is no problem incidental to the manual work as mentioned above.

Further, since each contact 4 to 8 is recessed in the contact holding member 3 to be held therein, each contact 4 to 8 is more securely held than the known art where each contact is simply fixed engagedly, and there is no such problem as producing unexpected play or looseness in the contacts 4 to 8. And by bending each contact 4 to 8 after being recessed in the contact holding member 3 as above-described, the accuracy in the relative position of each contact 4 to 8 can be greatly improved.

Furthermore, it is not necessary to provide such portions with which each contact is to be engaged as is required in the known art, in other words, it becomes unnecessary to provide a rather thick resin layer for securing the engaging parts, and the recessed parts of each contact 4 to 8 are useful for reinforcing the resin layer, making a thinner resin layer feasible, resulting in the realization of a small-sized and thin jack.

Moreover, the contact holding member 3 serves as an upper wall of the jack body, thereby the number of necessary components is decreased.

Since each terminal 4*b* to 8*b* of each contact 4 to 8 is provided extending downwardly from the contact holding member 3 mounted on the upper side of the jack body 1, there also arises the advantage of sufficiently securing a spacing for keeping flux from the entrance.

The manner of forming the jack with recessed contacts in accordance with this invention is not limited to the first embodiment. For example, the switch structure 2 can be formed in a manner as described in the following second to eighth embodiments.

Figure 5:
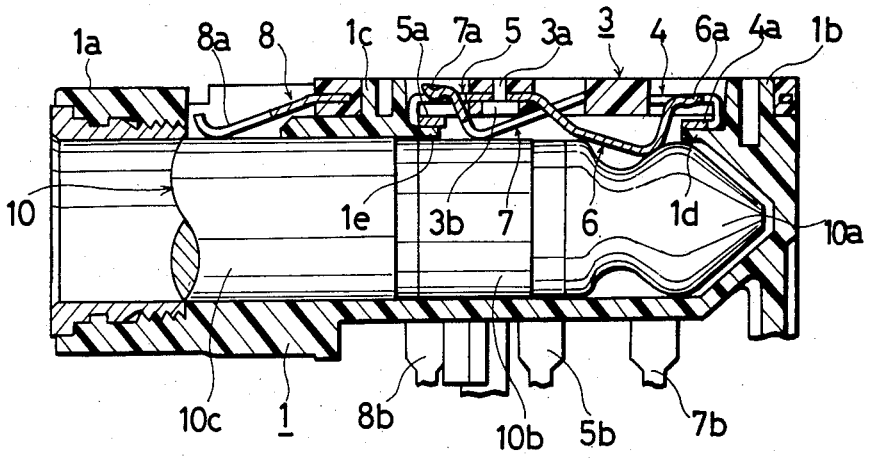
Figure 6:
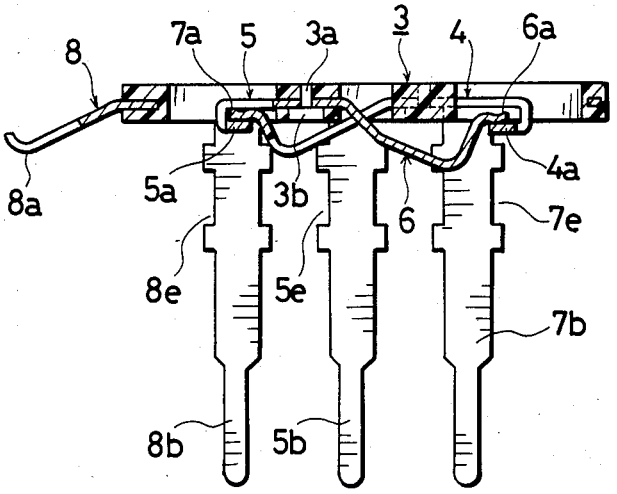

In the second embodiment illustrated in FIG. 5 and FIG. 6, the contact areas 4*a*, 5*a* of each stationary contact 4, 5 are bent downward forming a ]-shape, although such other features as formation of the contact collection plate 9 are the same as the preceeding first embodiment.

By employing such a construction, the contact face between each contact area 4*a*, 5*a* of each stationary contact 4, 5 and each contact area 6*a*, 7*a* of each movable contact 6, 7 as well as the contact face between each movable contact 6, 7, 8 and the plug 10 is located on one side or under side of the contact collection plate 9 illustrated in FIG. 3, and it is not necessary to provide said electro-conductive film on both sides of the contact collection plate 9 in view of securing the electro-conductivity as is required in the case of the first embodiment. Thus only plating one side of the collection plate 9 is sufficient for securing the electro-conductivity, thereby the required quantity of such costly material as silver is reduced or decreased resulting in a considerable cost saving.

Although in the foregoing first and second embodiments, such unexpected trouble as dislocation downward of each contact area 4*a*, 5*a* as a result of resilient contact with each corresponding contact area 6*a*, 7*a* of the movable contacts 7, 7 is to be prevented by retaining or supporting each contact area 4*a*, 5*a* of the stationary contacts 4, 5 on the supporting parts 1*d*, 1*e* formed on the jack body 1, it is not always necessary to form such supporting parts 1*d*, 1*e* particularly on the jack body 1. It is also possible to form the supporting parts (now illustrated) performing the same function as the parts 1*d*, 1*e* on the contact holding member 3.

Figure 7:
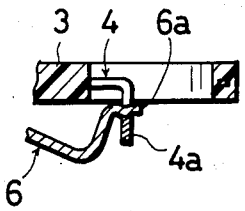
FIG. 7 is a longitudinal sectional view of an essential part illustrating another modification embodying a third embodiment.

Further, in the third embodiment illustrated in FIG. 7, each contact area 4*a*, 5*a* of each stationary contact 4, 5 is bent downward forming an L-shape so as to be orthogonal to each contact area 6*a*, 7*a* of each movable contact 6, 7 (the second stationary contact is not illustrated). By employing such a construction, the rigidity of each contact area 4*a*, 5*a* of the stationary contact 4, 5 can be greatly improved compared with the first and second embodiments, and the supporting parts 1*d*, 1*e* on the jack body 1 or the equivalent parts on the contact holding member 3 become unnecessary, thereby the shape or configuration of the jack body 1 or the contact holding member 3 is simplified.

Figure 8:
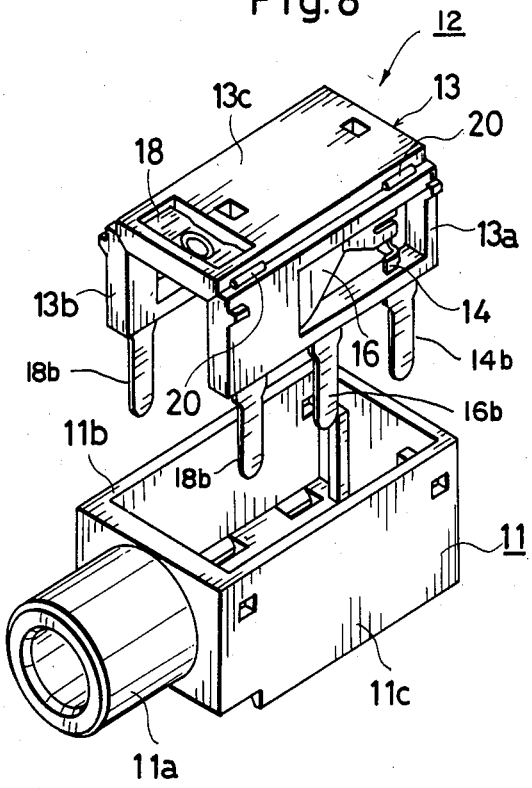
Figure 9:
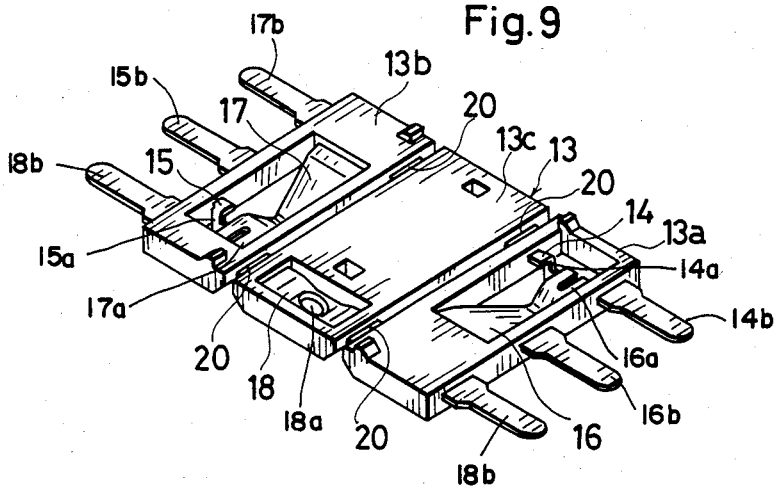
Figure 10:
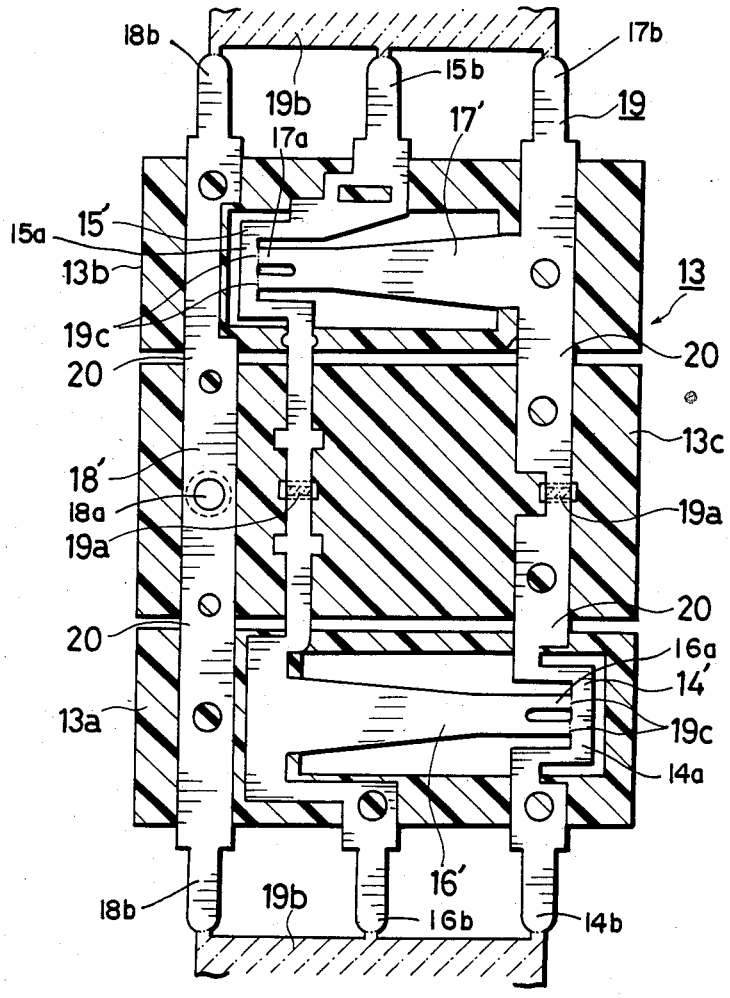

Furthermore, in the fourth embodiment illustrated in FIGS. 8 to 10, a contact holding member 13 of a switch structure 12 is formed into an ]-shape comprising a first contact holding member 13*a* in which a first stationary contact 14 and a first movable contact 16 are recessed to be held therein, a second contact holding member 13*b* in which a second stationary contact 15 and a second movable contact 17 are recessed to be held therein, and a third contact holding member 13*c*. The third contact holding member 13*c* is connected with the two contact holding members 13*a*, 13*b* through connecting pieces 20, 20 and includes a third movable contact 18 recessed to be held therein. Each contact holding member 13*a*, 13*b*, 13*c* is of flat plate construction. The contact holding member 13 is incorporated into a box-shaped jack body 11. The jack body 11 is equipped with its upper side open and with a plug insertion cylinder 11*a* (plug receiving cylinder) in such a manner that the first and second contact holding members 13*a*, 13*a* overlap each other and come in contact with the inner surface of side walls 11*b*, 11*c* of the jack body 11. In this respect, each connecting piece 20 is formed on a part of the contact. The side walls 11*b*, 11*c* of the jack body 11 and the first and second contact holding members 13*a*, 13*b* overlap each other. By employing such a construction, the rigidity of the jack body 11 is much improved. The formation of the ]-shaped contact holding member 13 is easily accomplished by bending each connecting piece 20 after molding the member 13 into a flat plate as illustrated in FIG. 9. Thereby automation in manufacturing the contact holding member 13 is also feasible in the same manner as each foregoing embodiment, resulting in easy and efficient production of the jack. Further in this fourth emodiment a contact collection plate 19 is formed by punching. The contact collection plate 19 has the shape illustrated in FIG. 10. Each contact holding member 13*a*, 13*b*, 13*c* is formed by injection molding with a part to be recessed of the contact collection plate 19 being placed in each cavity. After molding every unnecessary portion 19*b* (hatching portion in FIG. 10) is removed, each portion 19*a*, 19*c* between the contacts is cut off, and each contact area 14*a* to 18*a* of the parts 14' to 18', which serve as contacts 14 to 18, as well as each terminal 14*b* to 18*b*, is bent to be formed into the required shape. Thus, the contact holding member 13 having contacts 14 to 18, of which a developed state is illustrated in FIG. 9 is obtained. In this case, although each connecting member 20 is formed of a part of each contact as mentioned above, it is also possible as a matter of course for the member 20 to be of either a metallic piece, or a resin film, or a coating separate from the contact.

Figure 11:
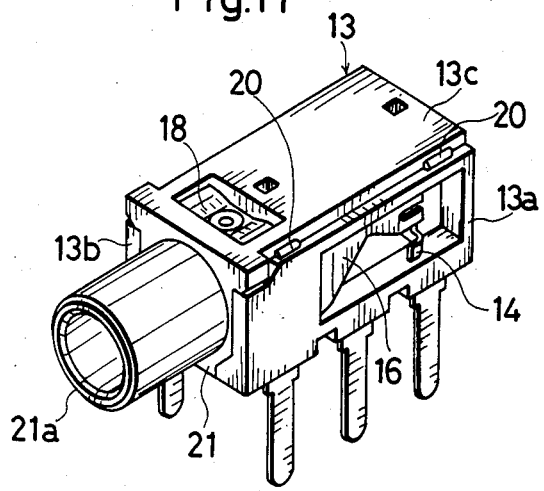
Figure 12:
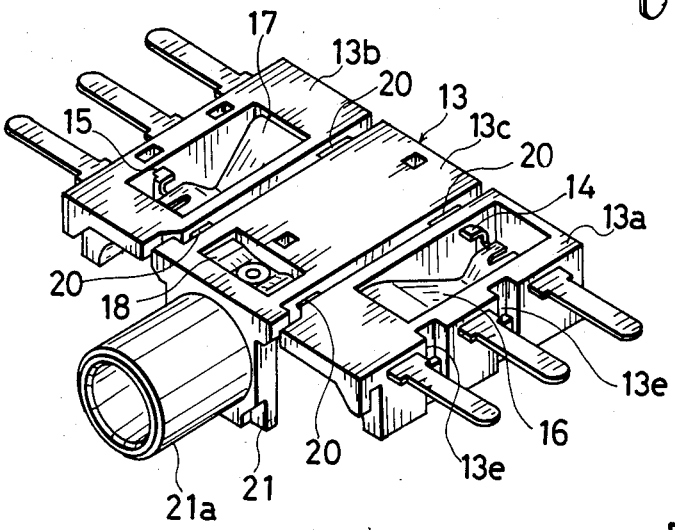
Figure 13:
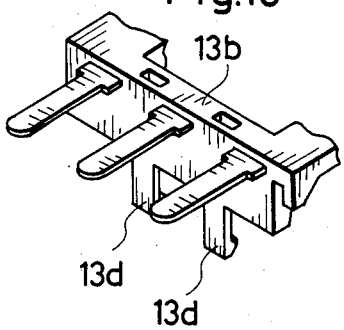

In the foregoing fourth embodiment, the jack body 11 and the contact holding member 13 are manufactured separately. On the other hand, in the fifth embodiment illustrated in FIGS. 11 to 13, the jack body is composed of the contact holding member 13. More particularly, as illustrated in FIG. 12, the contact holding member 13 and a front wall member 21 are formed integrally by injection molding into a developed state together while each contact 14 to 18 is inserted therein. A third contact holding member 13*c* is provided and a front wall member 21 extending downwardly from a front end thereof is equipped with a plug insertion cylinder 21*a*. Then first and second contact holding members 13*a*, 13*b* are turned downward through connecting pieces 20, and by engaging each pawl 13*d* formed on the second contact holding member 13*a* with each recessed portion 13*e* formed on the first contact holding member 13*a*, a jack is obtained, as illustrated in FIG. 11. The remaining formation is the same as the fourth embodiment. By employing such a construction, the entire jack can be easily and efficiently manufactured by automation. In this respect, in each of the fourth and fifth embodiments, the first, second and third movable contacts 16, 17, 18 are brought into contact with the chip 10*a*, ring 10*b* and ground device 10*c*, respectively.

In the foregoing fifth embodiment, it is also possible that the third contact holding member 13*c* and the front wall member 21 are made separately and then the holding member 13*c* and the front wall 21 are connected to each other through some connecting piece (not illustrated). By such a formation, each member 13, 21 can be of suitable material satisfying the intended function or operation thereof. To prevent the inner surface of the plug insertion cylinder 21*a* from abrasion due to repeatedly putting the plug 10 in and out of the plug insertion cylinder 21*a*, the front wall can be made of some abrasion resisting material, while each contact holding member 13*a*, 13*b*, 13*c* can be made of some heat resisting material.

Figure 14:
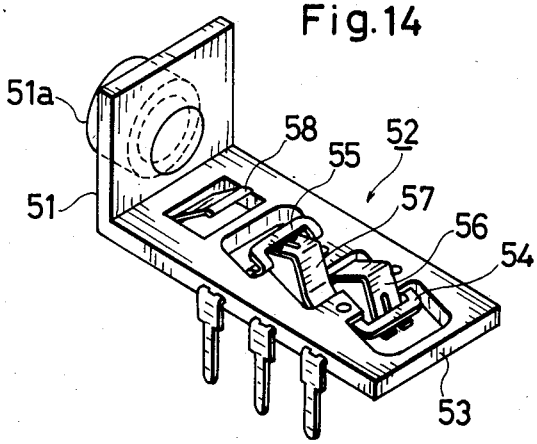
FIG. 14 is a perspective view of a jack illustrating a still further modification embodying a sixth embodiment.

In the case of the following sixth embodiment illustrated in FIG. 14, a front wall member 51 equipped with a plug insertion cylinder 51*a* is integrally formed on the front end of the contact holding member 53 in which first, second and third movable contacts 56, 57, 58 are recessed to be held therein, thus being formed into a jack. By employing such a construction, the jack can be obtained in the finished state resulting in the provision of a jack which is easily manufactured and at a reasonable cost. Concerning the formation of each contact 54 to 58 as well as the contact holding member 53 including the front wall member 51, the same method as the preceeding embodiments can be employed as a matter of course.

In each of the above-described first through sixth embodiments, this invention is applied to a jack with recessed contacts performing the contacting and separating operation therebetween, but this invention is further applicable to other types of jacks such as a jack with slide switch.

The seventh embodiment wherein this invention is embodied into a jack with a slide switch is illustrated in FIGS. 15 to 23.

In FIGS. 15 to 23, there are illustrated a jack body 100, a clip holder 120, a contact holding member 130 and a shielding plate 240, respectively.

The jack body 100 is formed into a box-shape with its upper side open, and in which a plug insertion cylinder 101 is formed on the center part of a front wall thereof. Plural pairs of L-shaped engaging pieces 112 are formed on a side wall adjacent to the front wall so that external terminals 134*a* to 134*i* extending downwardly from the contact holding member 130 may be positioned and held thereby.

In the jack body 100, a plug guide part 113 is formed on the wall where the plug insertion cylinder is provided, and the remaining part is formed into a slide switch holding part 114.

The plug guide part 113 has its inside diameter of the same dimension as the plug insertion cylinder 101, and communicates with the plug insertion cylinder 101 through the front wall. There is further provided recessed parts 115 on a predetermined position of the upper face of the jack body 100 for positioning the contact holding member 130.

In the slide switch holding part 114, the center part thereof is semi-circularly concaved, and guide grooves 116 are formed for guiding the clip holder 120 putting the holder 120 therebetween. Recessions 117 for stopping the clip holder are provided at predetermined positions of the inside of the body 100. The outer periphery of the plug insertion cylinder 101 is screw-threaded.

The clip holder 120 is of such a width to be sufficiently inserted into the slide switch holder 114 without play, and downwardly extending parts 121, to be engaged with the guide grooves 116, are provided at predetermined positions on the underside of the holder 120. Further in the clip holder, a clip, i.e. a change-over piece 123 is engagedly inserted in a hole 122 formed on the upper side. Furthermore, an end portion to be located on the side of the plug guide part 113 is formed on a supporting part 124, which engages with a neck 161 of the plug end. A portion continuing from the supporting part 124 is formed on a plug receiving part 125 having almost the same shape as the plug end. Projections 126 to be engaged with the recessions 117 for stopping the clip holder are formed on a predetermined position of the side wall of the clip holder 120.

The supporting part 124 is made of such a material as synthetic resin so as to be elastically deformed when putting the plug in and out.

The contact holding member 130 is also made of electrical insulating material such as synthetic resin. Legs 131 to be engaged with the recessed parts 115 are provided at predetermined positions on the underside thereof, a cutaway part 132 is formed to be located right above the plug guides 113, through holes 133 are formd to be right above the slide switch holder 114 and the change-over piece 123 respectively, and a plurality of external terminals 134*a* to 134*i* are supported extending downwardly from the side walls.

In the contacts (a ground spring contact 135, a ring spring contact 136 and a chip spring contact 137) and the slide switch stationary contacts 144*a* to 144*c*, 145*a* to 145*c* connected with the external terminals 134*a* to 134*i*, the external terminal 134*a* is associated with the ground spring contact 135, the external terminal 134*b* is associated with the ring spring contact 136, the external terminal 134*c* is associated with the chip spring contact 137, and the external terminals 134*d*, 134*e*, 134*f*, 134*g*, 134*h*, 134*i* are associated with the slide switch stationary contacts 144*a*, 144*b*, 144*c*, 145*a*, 145*b*, 145*c*, respectively. The ground spring contact 135 and the ring spring contact 136 are bridged over the cutaway part 132 in parallel with each other in such a manner that the center parts of the contacts 135, 136 are bent and convexed downward. The chip spring contact 137 projects slightly downwardly to the through holes 133, and the formed curved end part of which is to be engaged with the neck 161 of the plug end. The slide switch stationary contacts 144*a* to 144*c*, 145*a* to 145*c* are formed projecting downward to the through holes 133 right above the change-over piece 123 and extending downwardly therefrom so as to selectively come in contact with the change-over piece 123.

In the shielding plate, mounting legs 241 are vertically provided on the outer surface of a flat plate for covering the upper face of the contact holding member 130, and by bending the lower part of each leg 241 inward, each leg 241 can be combined with the jack body 100 while the contact holding member 130 is put among the legs 241.

Figure 22:
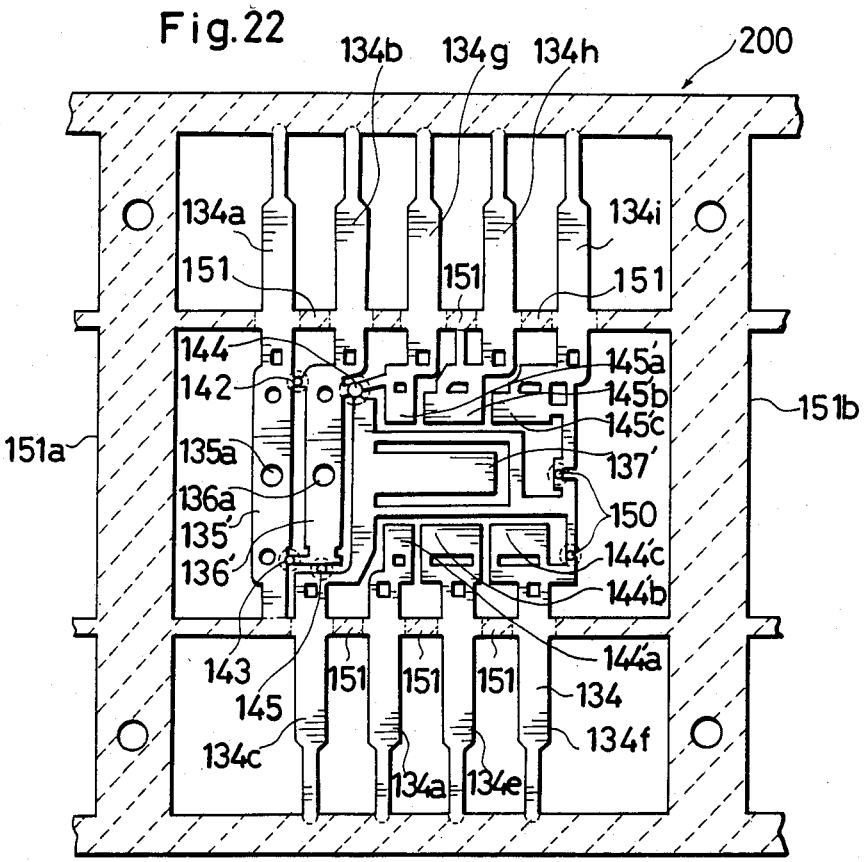
Figure 23:
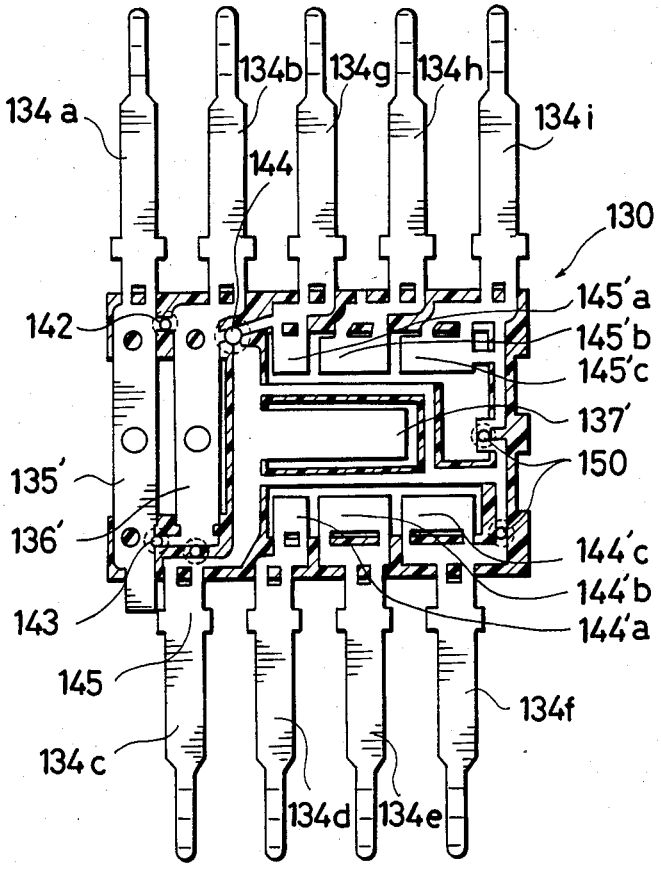

The manufacturing process of the contact holding member 130 is described referring to FIG. 22 and FIG. 23.

In the first step, as illustrating in FIG. 22, a metal plate is punched to obtain a contact collection plate 200 in which each part 135' to 137', 144'*a* to 144'*c*, 145'*a*, 145*c'* which are to become contacts 135 to 137, 144*a* to 144*c*, 145*a*, 145*c* is collectively placed in connection with each other in any part thereof and not to overlap each other on the same plane. In this step, it is preferred that as the case may be, relatively slight bending or projecting parts are formed beforehand to the extent not affecting the planenss of the contact collection plate 200. In the case of this embodiment, such projecting parts or projections are formed on each part 135', 136' to become contacts 135, 136 of the ground spring and ring spring.

Then, in order to secure satisfactory electro-conductivity, a highly electro-conductive film is formed on both sides of the contact collection plate 200. Namely, such an electro-conductive material as silver is plated on both sides of the collection plate 200. Such plating, however, is not necessary when using the same plated material or clad material as the plate.

The contact holding member 130 is formed by injection molding in a cavity between a male mold and a coresponding female mold (not illustrated). In this step, the contact collection plate 200 is horizontally held while a part to be recessed being placed in said cavity as illustrated in FIG. 23.

In the next step, by cutting each unnecessary portion 142 to 145, 150, 151, 151*a*, 151*b* (indicated by hatching portion in FIG. 22) of the contact collection plate 200, the contact holding member 200 is obtained while each part 135' to 137', each stationary contact 144'*a* to 144'*c*, 145'*a* to 145'*c* of the slide switch is recessed and held in the separate state (see FIG. 9). In this respect, as the portions 142 to 145, 150 of the unnecessary portions are in the recessed state in a resin layer, cutting off thereof occurs using through holes 146 provided vertically on the upper and lower sides of the portions 142 to 145, 150 for introduction of a punching tool.

Then, a part not to be recessed of each part 135' to 137', 144'*a* to 144'*c*, 145'*a* to 145'*c* is bent to form the contact 135 to 137, 144*a* to 144*c*, 145*a* to 145*c* for the jack circuit.

Further, each external terminal 134*a* to 134*i* of each contact 135 to 137, 144*a* to 144*c*, 145*a* to 145*c* is bent to extend downwardly from the left and right sides of the contact holding member 130 respectively.

Figure 15:
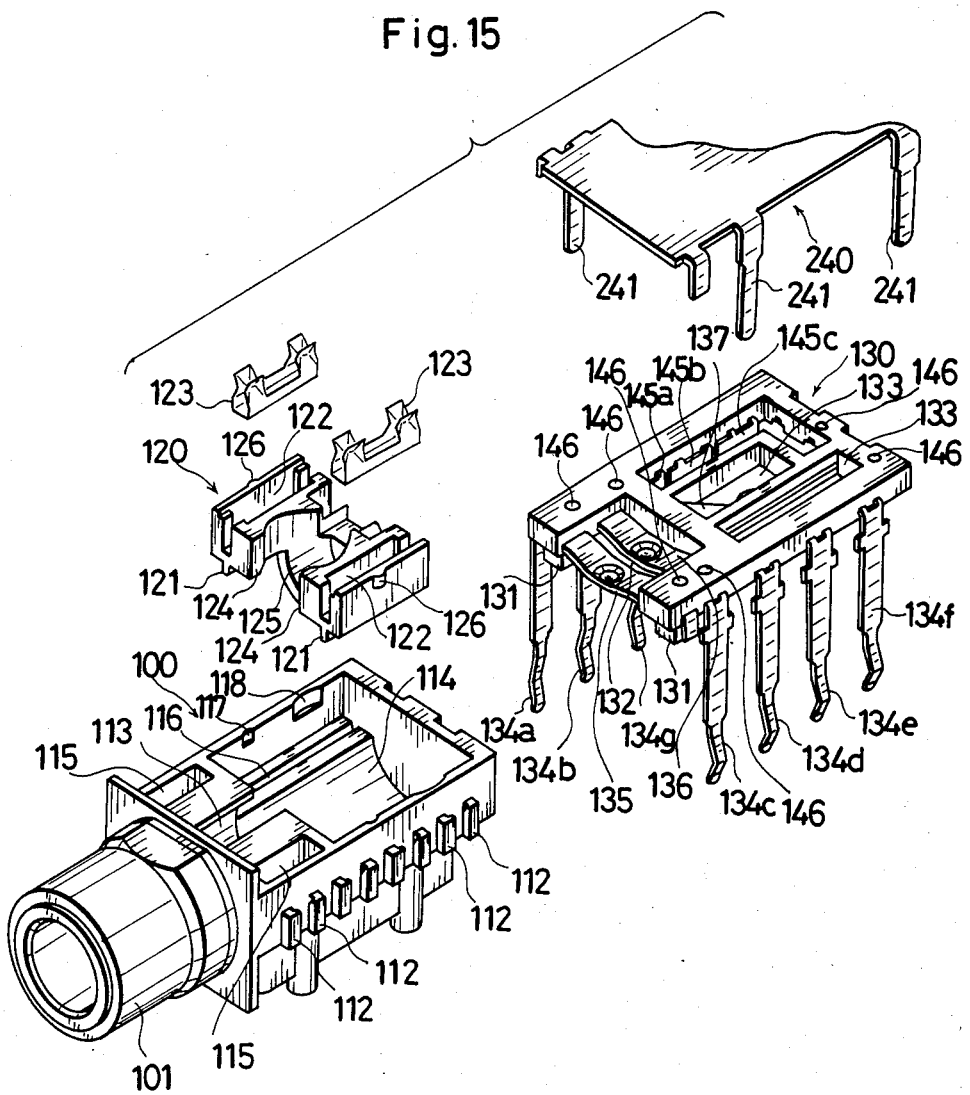
Figure 16:
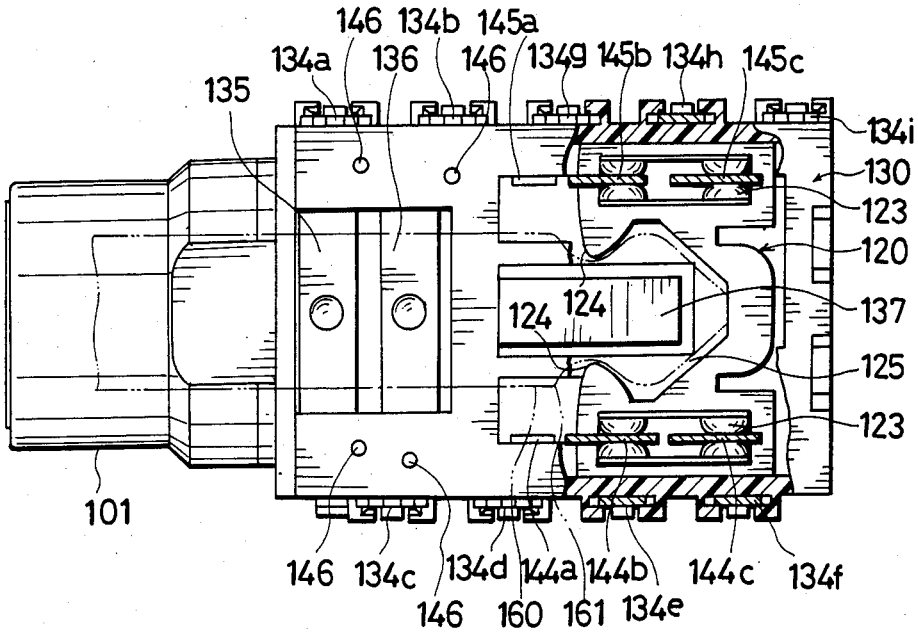
Figure 17:
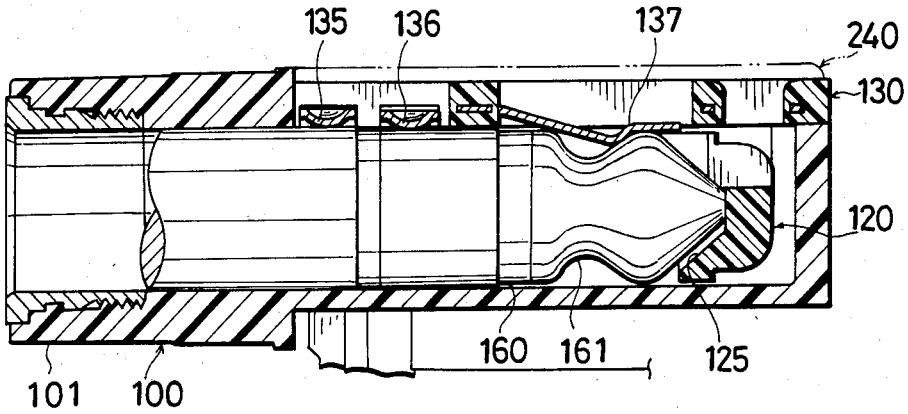
Figure 18:
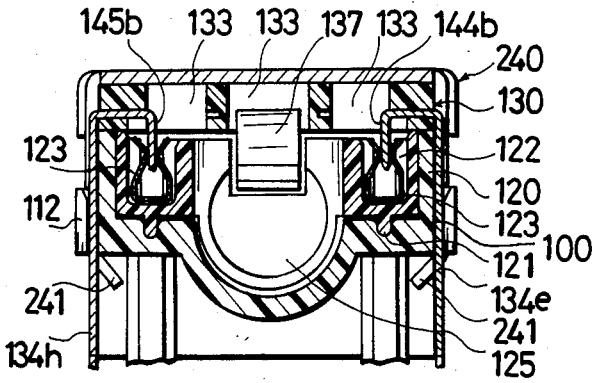
Figure 19:
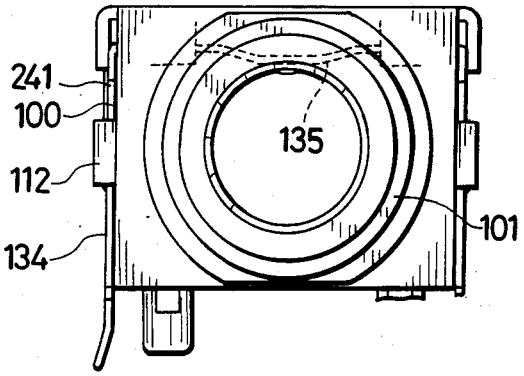
Figure 20:
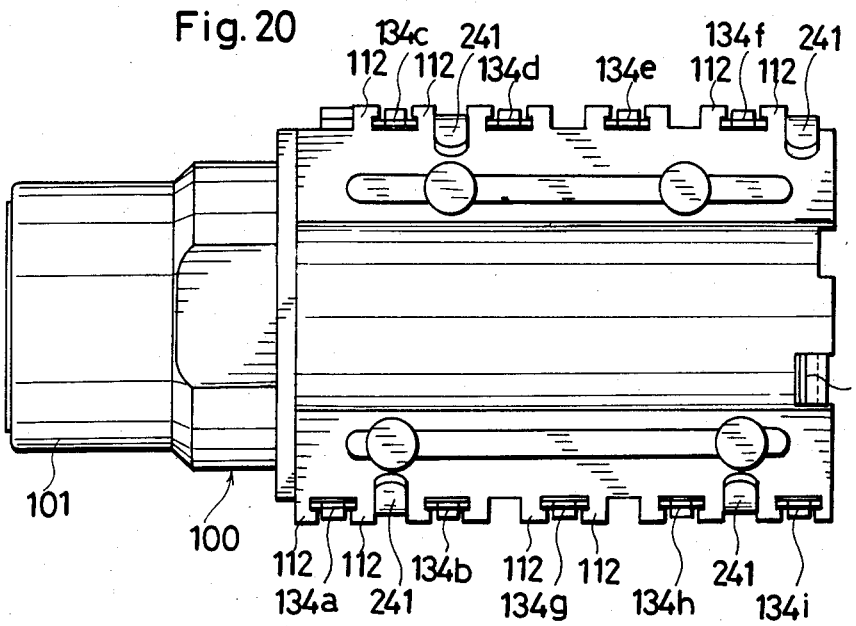
Figure 21:
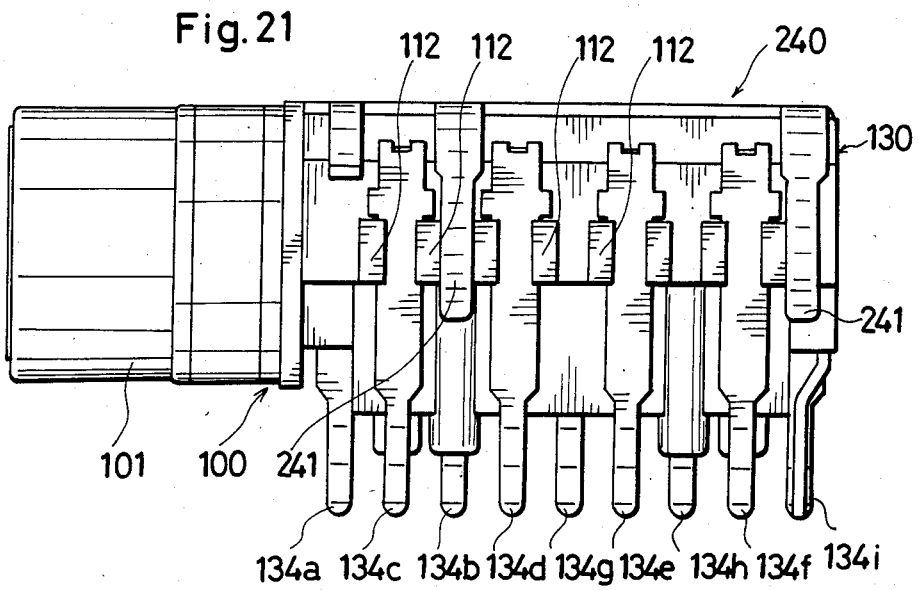

In this manner, the contact holding member 130 in which each contact 135 to 137, 144*a* to 144*c*, 145*b* to 145*c* is recessed to be held therein is satisfactorily obtained or manufactured as illustrated in FIG. 15.

The operation of the jack with a slide switch embodying this invention is described hereinafter.

When inserting or putting the plug 160 in the plug insertion cylinder 101, the plug end comes into contact with the supporting part 124 of the clip holder 120 so as to slide the clip holder 120 and to elastically deform the supporting part 124 for engagement with the neck 161 of the plug end. Thus, the plug 160 connects with the ground spring contact 135, the ring spring contact 136 and the chip spring contact 137, and by the operation of the change-over piece 123 of the clip holder 120, the corresponding two pairs of stationary contacts 144*b*–144*c*, 145*b*–145*c* of the slide switch are turned to the "ON" state, while the other pairs of stationary contacts 144*a*–144*b*, 145*a*–145*b* being turned to the "OFF" state.

When withdrawing the plug 160 out of the cylinder 101, the clip holder 120 slides by the engagement between the neck 161 of the plug end and the supporting part 124, and the plug can be withdrawn by the elastic transformation of the supporting part 124.

Since each recession 117 engages with each projection 126 for positioning the clip holder 120, the holder 120 is effectively prevented from deviating from of its due position, and by providing each groove 118 in addition to each recession 117, the error due to the length of the plug 160 can be effectively absorbed. In this respect, such a groove 118 is not necessary to be formed when there is no necessity of considering creep deformation of the projection 126.

Figure 24:
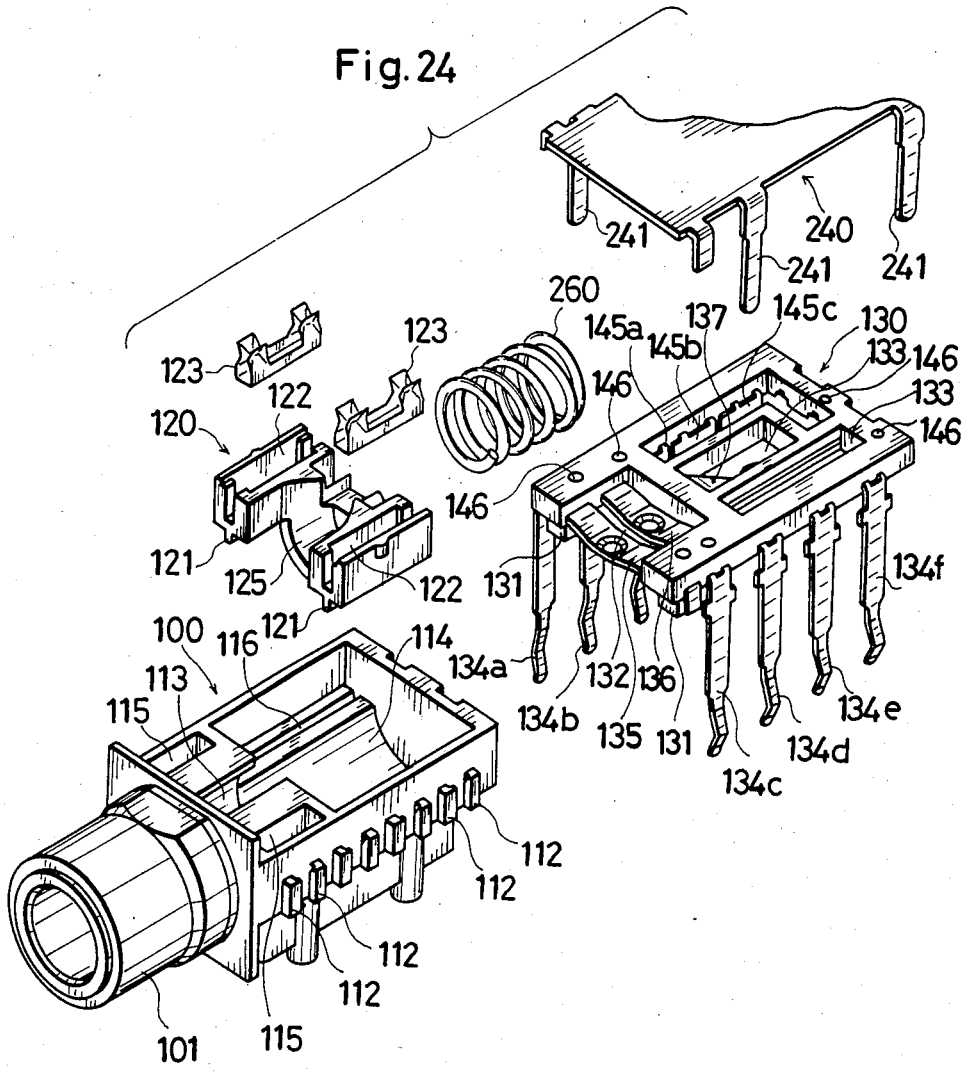
Figure 25:
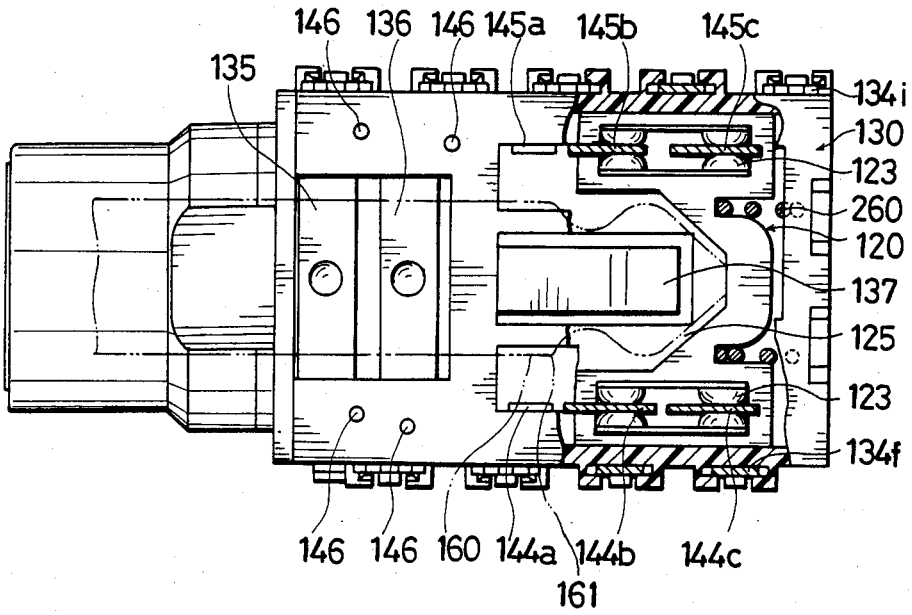
Figure 26:
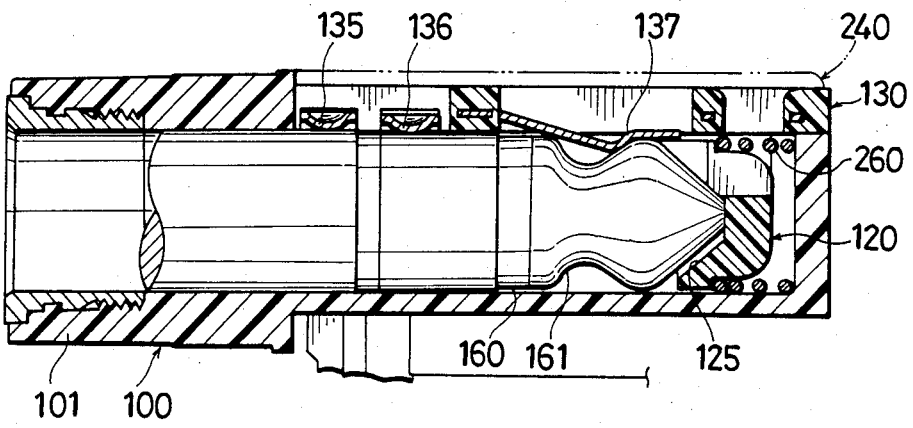

In the foregoing seventh embodiment applying this invention to the jack with a slide switch, the clip holder 120 slides in the direction for withdrawing the plug out from engagement between the neck 161 of the plug 160 and the supporting part 124 of the clip holder 120. Further, the following construction is also preferred in place of forming the supporting part 124 of the clip holder 120. Namely, in the eighth embodiment of this invention, a coil spring 260 is provided as illustrated in FIGS. 24 to 26, and by extension or the extending force of the coil spring 260 the clip holder 120 can slided in the direction for withdrawing the plug. In the case of using the coil spring 260, a force moving the plug 160 back in the insertion direction is produced by contraction of the coil spring 260 when inserting the plug, but such a force is smaller than the pressing force applied to the periphery of the plug 260 from each contact 135 to 137, thereby the plug 160 is not actually moved back.

By employing the construction of the preceding seventh or eighth embodiment, the step of obtaining the contact collection plate 200 from a metal plate, the step of injection molding the contact holding member 130 while the contact collection plate 200 is inserted therein, and the step of bending each contact 135 to 137 and stationary contact 144*a* to 144*c*, 145*a* to 145*c* to be a required shape and separated from the contact collection plate 200 can be continuously carried out on the same line. Thus automation in manufacturing the contact holding member 130 while each contact 135 to 137, 144*a* to 144*c*, 145*a* to 145*c* is recessed therein is feasible and easily achieved. Consequently, the manufacture of the contact holding member, or eventually the manufacture of the whole jack with a slide switch can be efficiently carried out greatly contributing to the provision of the jack with a slide switch at reasonable cost in the same manner as the preceding first to sixth embodiments.

Since each contact 135 to 137 as well as each stationary contact 144*a* to 144*c*, 145*a* to 145*c* of the slide switch is recessed in the contact holding member 130 to be held therein, each contact is more securely held and there is no such problem as producing unexpected play in each contact. Since each contact is bent after being recessed in the contact holding member 130, the accuracy in relative positions of each contact is greatly improved. Since it is not necessary to provide any engaging part on the jack body for securing each jack into the jack body, i.e. it becomes unnecessary to provide a rather thick jack body, a small-sized and thin jack with slide switch is feasible in the same manner as the preceding first to sixth. embodiments.

It will be evident to those skilled in the art that the present invention is not limited to the details of the foregoing illustrative embodiments, and that the present invention may be embodied in other specific forms without departing from the essential attributes thereof, and it is therefore desired that the foregoing embodiments be considered in all respects as illustrative only and not restrictive, reference being made to the appended claim rather than the foregoing description, and all changes which come with the meaning and the range of equivalency of the claim are therefore intended to be embraced therein.

What is claimed is:

1. A jack with recessed contacts, comprising:

a metal contact collection plate including a plurality of contacts, said contact collection plate having a lateral extent with the contacts being arranged along the lateral extent so that, when the contact collection plate is viewed in development, the contacts do not overlap; and a contact holding member of molded electrical insulating material molded to a portion of the contact collection plate within which a portion of each contact is recessed, wherein the parts of the contacts remote from the recessed portions are severed when the contact collection plate is punched; at least one pair of said plurality of contacts have contacting areas serving to contact and separate from one another in a contacting and separating operation initiated by a plug being received in and withdrawn from said jack; the contacting areas define contacting faces; the contacts defining the contacting areas are bent so that the contacting faces are in opposed relationship; and the contact holding member being received in and forming a sidewall of a plug-receiving jack body.

2. The jack as defined in claim 1, wherein the contacts are situated in substantially the same plane of said contact collection plate, and wherein the contacts are finally defined subsequent to punching the contact collection plate.

3. The jack as defined in claim 1, wherein the contact holding member defines at least one hole used when the remote parts of the contacts are severed.

4. The jack as defined in claim 1, further comprising: an electro-conductive film formed on one side of said at least one pair of contacts.

5. The jack as defined in claim 1, wherein one contact of said at least one pair of contacts is bent orthogonal to the contact of the other of said at least one pair of contacts.

6. The jack as defined in claim 1, wherein one contact of said at least one pair of contacts, is stationary.

7. The jack as defined in claim 1, wherein the contact holding member comprises a plurality of parts one of which embodies said body, said body being connected to the other parts of the contact holding member by bendable connecting pieces.

8. The jack as defined in claim 1, wherein the contact holding member comprises a plurality of parts connected by bendable connecting pieces.

9. The jack as defined in claim 8, wherein each connecting piece forms part of a contact.

10. The jack as defined in claim 1, wherein the body is formed as part of the contact holding member, said body having a front wall from which a plug insertion cylinder extends.

11. The jack as defined in claim 10, wherein the contact holding member comprises electrical insulating and heat resisting material, and wherein said front wall includes electrical insulating and abrasion resisting material.

* * * * *